US005709227A

United States Patent [19]

Arzonico et al.

[11] Patent Number: 5,709,227

[45] Date of Patent: Jan. 20, 1998

[54] DEGRADABLE SMOKING ARTICLE

[75] Inventors: Barbara Walker Arzonico, Winston-Salem; Michael Francis Dube; Glenn Edward Creamer, both of Pfafftown; Robert Leslie Oglesby, Kernersville; Charles Ray Ashcraft, Winston-Salem; Robin Kent Wilson, Clemmons, all of N.C.

[73] Assignee: R. J. Reynolds Tobacco Company, Winston-Salem, N.C.

[21] Appl. No.: 567,655

[22] Filed: Dec. 5, 1995

[51] Int. Cl.[6] ..... A24D 3/06

[52] U.S. Cl. ..... 131/341; 131/331; 131/360

[58] Field of Search ..... 131/365, 360, 131/341, 35, 37, 90, 331, 338, 340, 343; 257/32; 523/105; 428/372, 284

[56] References Cited

U.S. PATENT DOCUMENTS

| | | | |
|---|---|---|---|
| 2,819,720 | 1/1958 | Burbig | 131/336 |
| 3,431,166 | 3/1969 | Mizutani et al. . | |
| 5,180,765 | 1/1993 | Sinclair | 524/306 |
| 5,359,026 | 10/1994 | Gruber . | |
| 5,403,871 | 4/1995 | Eden et al. . | |
| 5,439,011 | 8/1995 | Schneider | 131/360 |
| 5,453,144 | 9/1995 | Kauffman et al. | 156/213 |
| 5,497,793 | 3/1996 | Kubica | 131/331 |
| 5,509,430 | 4/1996 | Berger | 131/341 |

FOREIGN PATENT DOCUMENTS

| | | |
|---|---|---|
| 0 614 620 A2 | 9/1994 | European Pat. Off. . |
| 0 641 525 A2 | 3/1995 | European Pat. Off. . |
| 0 612 482 A1 | 8/1995 | European Pat. Off. . |
| 93/24685 | 12/1993 | WIPO . |
| 94/16581 | 8/1994 | WIPO . |
| 95/16369 | 6/1995 | WIPO . |

OTHER PUBLICATIONS

English Abstract of Japanese Appln. No. JP–6–327454 dated Nov. 29, 1994.

English Abstract of Japanese Appln. No. JP–7–31452 dated Feb. 3, 1995.

English Abstract of Japanese Appln. No. JP–7–8255 dated Jan. 13, 1995.

*Primary Examiner*—Vincent Millin

*Assistant Examiner*—Charles W. Anderson

[57] ABSTRACT

A degradable smoking article comprises a tobacco rod and a filter component made of a gathered web of moisture disintegrative sheet material wrapped with a moisture disintegrative plug wrap bonded along a longitudinal seam with a water soluble adhesive. A moisture disintegrative tipping paper coated on one side with a water soluble adhesive secures the tobacco, rod and filter component together. The combination of moisture and other natural elements such as sunlight, mechanical abrasion, etc., dissociates the components of the smoking article over a relatively short period of time. Other embodiments of the filter component include a hollow degradable tube and a monolithic extruded starch filter rod.

18 Claims, 2 Drawing Sheets

DEGRADABLE SMOKING ARTICLE

FIELD OF THE INVENTION

The present invention relates to smoking articles and more particularly to a degradable smoking article such as a cigarette, which is altered by natural elements from its typical spent condition to a separated or dissociated condition which accelerates the degradability of the individual smoking article components.

BACKGROUND OF THE INVENTION

The desirability of manufacturing disposable goods, such as smoking articles, using degradable or biodegradable components for environmental preservation purposes is now a well-established concept. As applied to the manufacture of smoking articles, particularly cigarettes, the concept of degradability or biodegradability has focused upon cigarettes provided with filters since the filter components are typically the least degradable or biodegradable of all the components of a spent cigarette.

During smoking, of course, most of the tobacco rod and its circumscribing paper wrapper are converted to gases, and ash in an incineration process. The remaining components of the spent cigarette include a small portion of ash, tobacco rod and wrapper, the filter plug, the plug wrap, the filter tipping paper wrapped about the tobacco rod and filter and the adhesives that secure those components together.

Although there are numerous designs of cigarette filters, the most common filtration material is a condensed cellulose acetate tow which is not readily degradable or biodegradable. Much of the effort expended to reduce the environmental burden of spent cigarettes or to make such spent cigarettes more environmentally compatible has been directed to improving the biodegradability of the cellulose acetate fibers. One approach has included the use of water soluble polymers instead of triacetin which solvent bonds the cellulose acetate fibers typically used to make cigarette filters. See, e.g., EP Publication No. 634 113. Another approach involves the use of specific cellulosic ester fiber compositions that have improved biodegradability. See, e.g., PCT Publication No. W093/24685. Still other approaches involve the incorporation of water expandable gels in the filter material to swell the filter upon contact with moisture and thereby break open the filter tipping paper to expose the filter material to the elements. See EP Publication No. 614 620.

It has also been suggested in EP Publication No. 612 482 to make the components of a cigarette filter, including the filtration material, the filter plug wrap and the tipping paper of a moisture disintegrative paper. The use of water soluble adhesives for securing the filter plug and tipping paper wrappings is also known.

While various solutions have been heretofore advanced to make smoking articles, including filter cigarettes, more degradable or biodegradable and therefore more environmentally compatible, none of the known solutions is believed to address the optimization of the degradability of all the components of spent filter cigarettes. It would be desirable therefore to provide a filter cigarette which is characterized by a relatively rapid degradation of all the cigarette components by separation or dissociation of those components followed by a longer term biodegradability of the components.

SUMMARY OF THE INVENTION

The present invention is directed to a degradable smoking article, particularly to a degradable filter cigarette, which is separated or dissociated into its individual components by exposure to natural elements, e.g., moisture, sunlight, mechanical abrasion, etc., over a relatively short period of time, for example, in the range of about one to six weeks and preferably no more than about two weeks. Subsequent to that relatively rapid separation or dissociation of the cigarette components, some or all of the components are preferably aerobically or anaerobically biodegradable to as great an extent as possible over a longer period of time.

According to the invention, the filter component comprises in one embodiment a gathered, corrugated or uncorrugated web of moisture disintegrative sheet material, such as a melt blown or spun-bonded, non-woven web of polylactic acid, a melt blown sheet of polyvinyl alcohol, an unstabilized polypropylene sheet material, or a wood pulp/cellulose acetate composite sheet. The gathered filter material web or sheet is wrapped with a plug wrap also made of a moisture disintegrative sheet material, such as a paper with no wet strength chemicals, e.g., a paper made by Ecusta Paper Co., a division of P. H. Gladfelter, of Pisgah Forest, N.C., under the designation 30535, a paper made by Wattens Papiers of Wattens, Austria under the designation 646 or a Dissolvo® paper, commercial grade 2830 made by Mishima Paper Mfg. Co., Ltd. of Tokyo, Japan and imported by CMS Gilbreth Packaging Systems, Inc. of Bensalem, Pa. described generally in U.S. Pat. No. 3,431,166, the disclosure of which is incorporated herein by reference. As use, herein, references to Dissolvo® paper include the paper described in the aforesaid U.S. Pat. No. 3,431,166 and its equivalents whether or not sold under the Dissolvo® trademark. The plug wrap is bonded along a longitudinal seam by a water soluble adhesive, such as a liquid starch adhesive, a water soluble hot melt adhesive or an EVA or PVA adhesive to form a filter plug.

In a second embodiment of the invention, the filter component is made of an extruded starch material, such as a food grade tale starch, e.g., corn, potato, wheat, etc., with a generally open cell structure and having a diameter of about 7–8 mm comparable to a conventional cigarette filter. In this embodiment, no plug wrap is necessary because the filter component is a monolithic rod.

In a third embodiment, the filter component is made of two segments, a first segment comprising a relatively short segment of a conventional cellulose acetate filter material, a gathered sheet of polylactic acid, polyvinyl alcohol, wood pulp/cellulose acetate composite or unstabilized polypropylene and a second segment comprising a hollow tube or straw extruded from polyvinyl alcohol, starch, corn meal or other water soluble material. The two segment filter is then wrapped with a plug wrap, which may be the aforesaid Dissolvo® paper, and bonded with a water soluble adhesive, such as a starch adhesive.

The tobacco rod for use with each of the filter component embodiments is made of conventional tobacco blends overwrapped with a conventional cigarette paper which is relatively moisture disintegrative. The wrapping paper is bonded along a longitudinal seam with a water soluble adhesive, such as a liquid starch adhesive, or an EVA or PVA adhesive.

The filter plug and tobacco rod are then combined on conventional filter cigarette-making machinery with a tipping paper also made of a moisture disintegrative paper coated with a water soluble adhesive and bonded to the filter plug and tobacco rod.

The tipping paper is preferably the Dissolvo® commercial grade 2830 paper described above as being used for the plug wrap, but modified by a thin printed ink coating, a thin coating of polyvinyl acetal or polyethylene, or a thin laminate of polyvinyl alcohol to reduce the porosity of the Dissolvo® paper. Other moisture disintegrative tipping papers may be used, such as an uncalendared wood pulp/calcium carbonate paper with no wet strength chemicals made under the designation 30535 by Ecusta, or a similar paper with no wet strength chemicals made by Feurstein of Traun, Austria under the material code designation M-5594.

The presently preferred water soluble adhesives useful in making the degradable cigarette of the invention include starch or hot melt adhesives made by National Starch & Chemical Co. of Bridgewater, N.J. 08807, as follows:

| | |
|---|---|
| Cigarette Paper Seam | Cycloflex 018-1096<br>Cycloflex 18-2600 |
| Tipping Paper Adhesive Coating | Cycloflex 018-1096 |
| Plug Wrap Seam | Cycloflex 7608-148-1 (hot melt)<br>Cycloflex 70-4073 (hot melt)<br>Cycloflex 18-2600 |

EVA or PVA adhesives may also be used preferably for the plug wrap seam.

The spent cigarette resulting from a filter cigarette constructed as described above is advantageously completely degradable, i.e., separated or dissociated, into its individual components within a relatively short period of time if it is exposed to moisture from rain, snow, dew or residual moisture from those elements, for example, moist earth. Other natural elements, such as sunlight, mechanical abrasion and aerobic biodegradation, may accelerate such separation or dissociation to some extent. In addition, the inherent moisture content in tobacco which ranges from about 9% to about 14% water by weight helps to initiate the moisture-related degradation of the components. For that reason, a tobacco moisture content toward the high end of the acceptable range of moisture content (12%–14%) is preferred.

Moisture initially solubilizes the water soluble adhesive bonds of the tipping paper and cigarette wrapping paper which causes the bonds to release thereby exposing the underlying filter plug and unburned tobacco. Preferably, the seam of the tipping paper is circumferentially offset from areas where the plug wrap bonded seam and the cigarette paper bonded seam are located so that external moisture, as well as the inherent moisture in the tobacco smoke passing through the tobacco rod and the filter material, cooperate to solubilize the water soluble bonds on the plug wrap, tipping paper and cigarette paper seams. Opening of the three above-described bonds essentially separates the cigarette into its individual components.

After separation of the spent cigarette into its individual components, the exposed surface area of those components is substantially increased so that the moisture disintegration of the filter material, plug wrap, tipping paper and cigarette paper proceeds more rapidly. Moisture disintegration, aided by degradation owing to sunlight, mechanical abrasion and the like proceeds until the spent cigarette components are not recognizable as components of a filter cigarette. Depending on the particular type of moisture disintegrative sheet material used to make the filter and wrap components, the sheet material may have degraded to a gel-like or flock-like form.

In a similar manner, the extruded starch filter component of the second embodiment will degrade to a soft, dough-like material which will further degrade into particulate matter or be carried away in small particles by insects, such as ants or the like. The above-described two segment filter component of the third embodiment will separate into a polyvinyl alcohol tube segment which will further degrade in the presence of moisture and a somewhat less degradable, but relatively small, mass of conventional cellulose acetate filter material. Thereafter, the individual elements of the various filter components, as well as the remaining tobacco in the spent cigarette are aerobically biodegraded over a longer period of time.

With the foregoing and other advantages and features of the invention that will become hereinafter apparent, the nature of the invention may be more clearly understood by reference to the following detailed description of the invention, the appended claims and to the several views illustrated in the drawing.

DETAILED DESCRIPTION OF THE INVENTION

Figure 1:
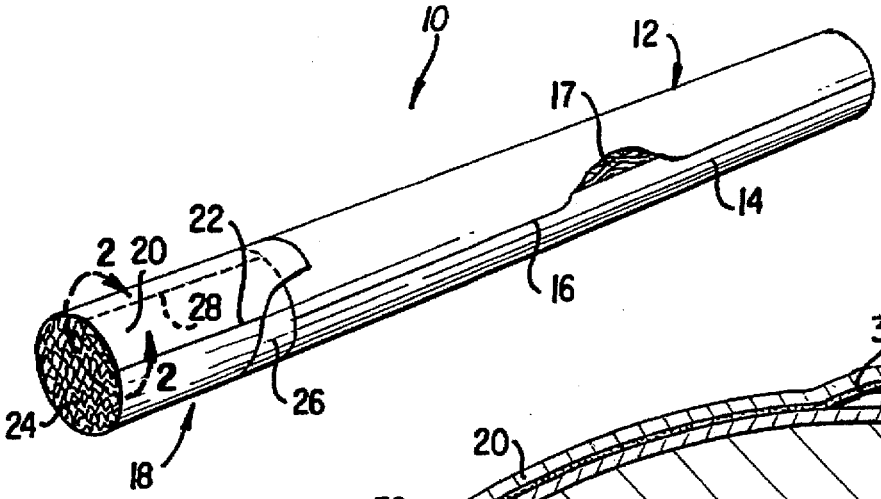
FIG. 1 is a partly broken perspective view of a degradable filter cigarette of the invention.

Referring now in detail to the drawings, there is shown in the perspective view of FIG. 1 a degradable cigarette according to the invention which is identified generally by reference numeral 10. Cigarette 10 comprises a rod 12 of smoking material, such as tobacco, overwrapped by a conventional cigarette wrapping paper 14, which is relatively moisture disintegrative, and glued along a longitudinal seam 16 with a water soluble adhesive 17. A filter plug or rod 18 is attached to the tobacco rod 12 by a moisture disintegrative filter tipping paper 20 which is coated on one surface with a water soluble adhesive 32 and overlapped along a longitudinal seam 22. Filter rod 18 is formed by a moisture disintegrative component 24, which is described in more detail hereinafter, and may be overwrapped by a moisture disintegrative plug wrap 26.

Figure 2:
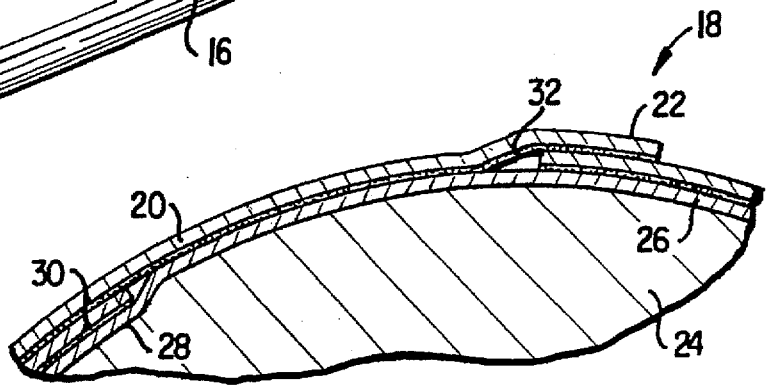
FIG. 2 is a fragmentary cross-sectional view of the filter of the cigarette shown in FIG. 1 at detail 2—2.

Referring to FIG. 2, the construction details of the filter rod 18 can be seen more clearly. The moisture disintegrative component 24 may be circumscribed by a moisture disintegrative plug wrap 26 and glued along a longitudinal seam 28 using a water soluble adhesive 30. The moisture disintegrative tipping paper 20 is wrapped about the filter rod 18 and tobacco rod 12 (FIG. 1) and bonded thereto by the water soluble adhesive coating 32 covering the inner surface of the paper 20. Preferably, the seams 16, 22, 28 are arranged to be angularly offset from one another as shown in FIGS. 1 and 2 for reasons discussed more fully hereinafter.

Figure 3:
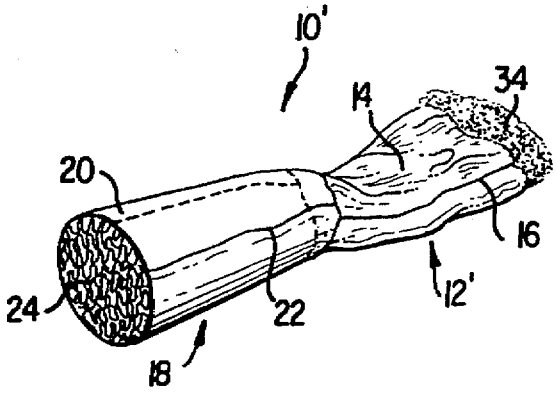
FIG. 3 is a perspective view of the filter cigarette of FIG. 1 after it has been smoked and discarded as a spent cigarette.

FIG. 3 illustrates the condition of a typical spent filter cigarette 10' immediately after it has been consumed by the smoker and discarded onto an outdoor surface S, e.g., on the ground, a street or a sidewalk. In this condition, the cigarette 10' comprises a short length of tobacco rod 12' with an extinguished coal or ash 34 at the free end thereof.

Figure 4:
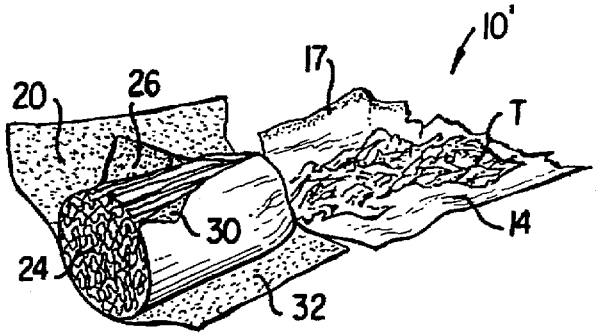
FIG. 4 is a perspective view of the spent cigarette of FIG. 3 showing the partial separation or dissociation of the components of the spent cigarette.

FIG. 4 illustrates a typical condition of discarded spent cigarette 10' of FIG. 3 after it has been exposed to the elements for a period of time on the order of several hours to several days, depending upon the quantity of moisture that contacts the spent cigarette. Initially, a certain minimum amount of moisture causes the water soluble adhesives 17, 32, 30 to solubilize and release their respective bonds at the seam 16 of the tobacco wrapping paper 14, at the tipping paper 20 and at the seam 28 of the plug wrap 26, respectively. Release of the adhesive exposes the remaining tobacco T in the tobacco rod and the filter component 24 thereby increasing the total surface area of the spent cigarette components that is available for exposure to the natural elements of moisture, sunlight and mechanical abrasion.

In a first embodiment of the invention, the filter component 24 is a gathered web of moisture disintegrative sheet material, such as:

(1) a non-woven sheet of melt blown or spun-bonded polylactic acid (PLA) having a basis weight of about 30–45 gm/m$^2$, preferably 30–38 gm/m$^2$, available from Fiberweb North America of Simpsonville, S.C.;

(2) a melt blown sheet of polyvinyl alcohol having a basis weight of about 23–47 gm/m$^2$ available from Kimberly-Clark Company of Roswell, Ga. under the product designations P4311-(153A, 153B, 177B, 177C, 85A, 85B, 85C);

(3) an unstabilized polypropylene sheet material with a prodegradant (photosensitive additive), and having a basis weight of about 23 gm/m$^2$ available from Kimberly-Clark under the product designation P4311-159B; and (4) a wood pulp/cellulose acetate material having an acetate to pulp ratio of from about 80/20 to about 50/50 and a basis weight of about 28–35 gm/m$^2$ available from Daicel Chemical Industries of Tokyo, Japan under the product designations A-950630-N, A940416-460, A950630C, A950830H and A950830S.

The above sheet materials are provided in widths of from about 5 inches to about 12 inches, suitable for gathering and forming into rods on conventional web gathering and rod forming apparatus, such as a Decoufle CU-20 or a Hauni KDF-2. The material may be corrugated or creped if desired or necessary to improve the formability or to adjust the density of the rod.

The preferred plug wrap 26 for tie gathered web filter component 24 is a Dissolvo® water soluble paper available from CMS Gilbreth under designation Grade No. 2830. Other Dissolvo® papers from CMB Gilbreth may also be used, such as Grade Nos. 2845, 2800, DP-45 or 30CD-2. The basis weight of the preferred Grade No. 2830 paper is about 30 gm/m$^2$. When used as a plug wrap, the Dissolvo® paper has a high porosity which facilitates the passage of moisture and air therethrough to the filter component. The plug wrap 26 may also be a paper made with no wet strength chemicals, such as a paper made by Ecusta under the product designation 30535.

The tipping paper 20 for combining the filter rod component 18 with the tobacco rod 12 is also a moisture disintegrative sheet material, such as:

(1) the commercial grade 2830 Dissolvo® paper having a basis weight of about 30 gm/m$^2$ and treated to reduce porosity by printing the paper with a "white ink" made of talc and nitrocellulose, by lamination thereto of a thin polyvinyl alcohol layer or by coating the paper with a thin layer of polyvinyl acetate or polyester; or (2) a paper with no wet strength chemicals added, such as an uncalendared wood pulp/calcium carbonate paper made by Ecusta under the designation 30535 or a similar paper available from Feurstein under the material code designation M-5594.

The preferred water soluble adhesives for the seam adhesives 17, 30 and adhesive coating 32 are liquid starch adhesives, such as a liquid starch available from National Starch & Chemical Company under the designation Cycloflex 018-1096 for the tipping paper coating 32, Cycloflex 18-2600 for the cigarette paper seam 17 and the plug wrap seam 30. Hot melt adhesives may also be used, such as the Cycloflex 70-4073 and 7608-148-1 made by National Starch. EVA and PVA adhesives may be used, such as an EVA adhesive available under the designation Reynotac CS-2201A made by RJR Custom Adhesives, Winston-Salem, N.C. 27105 and a PVA adhesive available under the designation Reynotac D-30HT also made by RJR Custom Adhesives. Non-water soluble hot melt adhesives, such as Reynotac 448-195K, may also be used for the plug wrap seam with a moisture disintegrative plug wrap. A filter center line or anchor adhesive may also be used, such as the aforesaid Reynotac D-30HT PVA adhesive.

Figure 5:
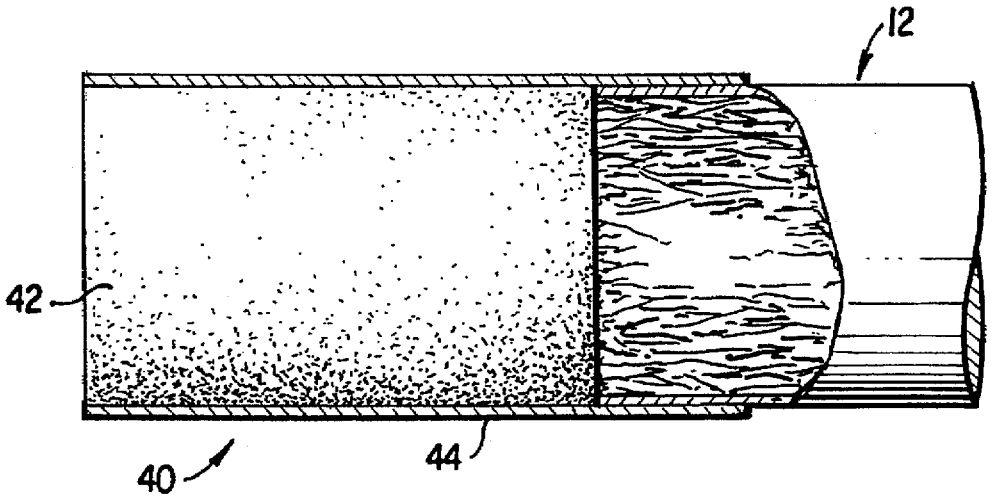
FIG. 5 is a cross-sectional view of a second embodiment of the filter component of the degradable cigarette of the invention.

Referring now to FIG. 5, a second embodiment of the degradable cigarette of the invention is illustrated in cross-section. In this embodiment, the filter component 40 comprises a monolithic rod 42 made of an extruded food grade starch, such as corn, potato or wheat starch, to which about 3% by weight glycerine has been added. The extrusion has a diameter of about 7–8 mm with a substantially open-celled structure, similar to an edible breadstick. Since the rod 42 is monolithic, no plug wrap is needed. The filter rod 42 is connected to tobacco rod 12 by means of tipping paper 44 which may be one of the water disintegrative tipping papers described above. Wetting of the extruded starch rod 42 will soften the rod into a dough-like mass which is readily disintegratable. Advantageously, insects, such as ants, will aid in the degradability of the extruded starch rod.

Figure 6:
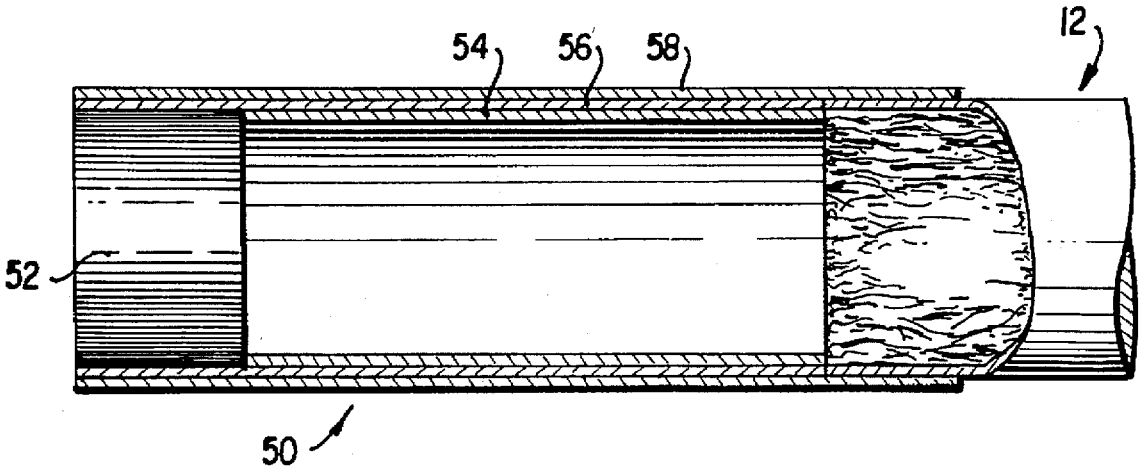
FIG. 6 is a cross-sectional view of a third embodiment of the filter component of the degradable cigarette of the invention.

With reference now to FIG. 6, a third embodiment of the degradable cigarette of the invention is shown in cross-section In this third embodiment, the filter component 50 is a two segment filter about 27 mm in length comprising a first segment 52, about 7–15 mm in length, and a second tubular segment, about 12–20 mm in length, which may be made of conventional cellulose acetate or one of the water soluble gathered web filter components 24 described above. The second tubular segment 54 comprises an extruded hollow tube or straw made of a degradable polyvinyl alcohol polymer material, such as the copolymer material available from Air Products Company under the designation Vinex #2144, and having a length of from about 12 to 20 mm. The first and second segments 52, 54 are combined with a water soluble plug wrap 56 as described above and the filter component 50 and tobacco rod 12 are combined with a tipping paper 58 which may be one of the water disintegrative tipping papers described above.

In this embodiment, the length of the first filter segment 52 which provides the necessary pressure drop for the cigarette advantageously has a small volume and mass which makes the segment readily dispersable or degradable. This embodiment of the degradable cigarette of the invention depends on a reduction of mass of the materials to be dispersed or degraded.

The cigarette papers, tipping papers and plug wrap of the second and third embodiments are bonded with one of the adhesives described above in connection with the first embodiment.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

We claim:

1. A degradable smoking article comprising a tobacco rod and a filter component, said filter component comprising a gathered web of moisture disintegrative sheet material overwrapped with a moisture disintegrative plug wrap, said plug wrap being bonded along a longitudinal seam thereof with a water soluble adhesive, a moisture disintegrative tipping paper overwrapping and securing together said tobacco rod and filter component, said tipping paper having an adhesive coating on one side thereof for adhesively bonding said tipping paper to the plug wrap of the filter component and the tobacco rod.

2. The degradable smoking article of claim 1, wherein said gathered web comprises a non-woven web of polylactic acid.

3. The degradable smoking article of claim 1, wherein said gathered web is a sheet material selected from the group consisting of a melt blown or spun-bonded, non-woven web of polylactic acid, a melt blown sheet of polyvinyl alcohol, an unstabilized polypropylene sheet material with a prodegradant and a wood pulp/cellulose acetate composite sheet.

4. The degradable smoking article of claim 1, wherein said plug wrap and tipping paper are sheet materials selected from the group consisting of a paper with no wet strength chemicals and Dissolvo® paper.

5. The degradable smoking article of claim 4, wherein said paper with no wet strength chemicals comprises an uncalendared wood pulp/calcium carbonate paper.

6. The degradable smoking article of claim 1, wherein said tipping paper is Dissolvo® paper modified by a coating or laminated layer to reduce the porosity of the Dissolvo® paper.

7. The degradable smoking article of claim 1, wherein said adhesives comprise water soluble starch or hot melt adhesives, the adhesive coating on the tipping paper covering substantially all of said one side of said tipping paper.

8. A degradable smoking article comprising a tobacco rod and a filter component, said filter component comprising first and second segments, said first segment comprising a hollow tube made of polyvinyl alcohol, said first and second segments being combined with a first water disintegrative plug wrap, said second segment comprising a gathered web of moisture disintegrative sheet material overwrapped with a second moisture disintegrative plug wrap.

9. The degradable smoking article of claim 8, wherein said filter component has a length of about 27 mm, said first segment having a length of from about 12–20 mm and said second segment having a length of from about 7–15 mm.

10. The degradable smoking article of claim 8, including a water disintegrative tipping paper combining said tobacco rod and said filter component.

11. The degradable smoking article of claim 11, wherein the water disintegrative plug wrap and tipping paper is Dissolvo® paper.

12. The degradable smoking article of claim 11, wherein the tipping paper is treated to reduce the porosity thereof.

13. The degradable smoking article of claim 8, wherein said second segment is one of cellulose acetate fibers and a gathered, moisture disintegrative, non-woven web.

14. A degradable smoking article comprising a tobacco rod and a filter component, said filter component comprising a melt blown or spun-bonded, non-woven, gathered web of polylactic acid overwrapped with Dissolvo® paper plug wrap, said plug wrap being bonded along a longitudinal seam with a water soluble adhesive, a Dissolvo® tipping paper overwrapping and securing together the tobacco rod and filter component, said Dissolvo® tipping paper having a water soluble adhesive coating on one surface thereof.

15. The degradable smoking article of claim 14, wherein said tobacco rod is wrapped with a moisture disintegrative paper and bonded along a longitudinal seam with a water soluble adhesive.

16. The degradable smoking article of claim 15, wherein said water soluble adhesives comprise a starch or hot melt adhesive.

17. A cigarette filter comprising a filter rod made of polylactic acid material.

18. The cigarette filter of claim 17, wherein said filter rod is a gathered, non-woven sheet of polylactic acid material.

* * * * *